US008053154B2

(12) United States Patent
Kadota et al.

(10) Patent No.: US 8,053,154 B2
(45) **Date of Patent: *Nov. 8, 2011**

(54) TONER AND IMAGE FORMING METHOD

(75) Inventors: Takuya Kadota, Kobe (JP); Masayuki Hagi, Minoo (JP); Yoshihiro Mikuriya, Nishinomiya (JP); Katsunori Kurose, Takarazuka (JP); Hiroaki Kato, Nagaokakyo (JP); Atsushi Yamamoto, Kawanishi (JP); Yoshimichi Ishikawa, Itami (JP); Masahide Inoue, Katsuragi (JP); Minoru Nakamura, Takarazuka (JP); Hideaki Yasunaga, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 921 days.

This patent is subject to a terminal disclaimer.

(21) Appl. No.: 11/681,530

(22) Filed: Mar. 2, 2007

(65) Prior Publication Data

US 2007/0207399 A1 Sep. 6, 2007

(30) Foreign Application Priority Data

Mar. 6, 2006 (JP) ..... 2006-059572

(51) Int. Cl.
*G03G 9/097* (2006.01)

(52) U.S. Cl. ..... 430/108.4; 430/108.6; 399/119

(58) Field of Classification Search ..... 430/108.4, 430/108.6, 108.7; 399/119
See application file for complete search history.

(56) References Cited

U.S. PATENT DOCUMENTS

| | | | | |
|---|---|---|---|---|
| 4,238,286 | A * | 12/1980 | Poeschl | 162/352 |
| 5,430,526 | A * | 7/1995 | Ohkubo et al. | 399/159 |
| 5,750,308 | A * | 5/1998 | Tsujita et al. | 430/123.4 |
| 5,814,428 | A * | 9/1998 | Kido et al. | 430/108.4 |
| 6,470,161 | B2 * | 10/2002 | Fujishiro et al. | 399/159 |
| 6,627,566 | B1 * | 9/2003 | Zou | 501/5 |
| 7,556,904 | B2 * | 7/2009 | Kadota et al. | 430/108.1 |
| 7,695,885 | B2 * | 4/2010 | Yasunaga et al. | 430/111.4 |
| 7,749,671 | B2 * | 7/2010 | Yamamoto et al. | 430/108.6 |
| 7,817,946 | B2 * | 10/2010 | Murakami et al. | 399/284 |
| 7,838,193 | B2 * | 11/2010 | Hagi et al. | 430/108.6 |
| 2002/0148106 | A1 * | 10/2002 | Tsukada et al. | 29/610.1 |
| 2003/0157418 | A1 * | 8/2003 | Lee et al. | 430/108.3 |
| 2006/0204882 | A1 | 9/2006 | Nozaki et al. | |
| 2006/0210902 | A1 | 9/2006 | Nakamura et al. | |
| 2006/0275686 | A1 * | 12/2006 | Kadota et al. | 430/108.6 |
| 2007/0026335 | A1 | 2/2007 | Yamamoto et al. | |
| 2007/0059625 | A1 * | 3/2007 | Yamamoto et al. | 430/108.6 |
| 2008/0199234 | A1 | 8/2008 | Hagi et al. | |

FOREIGN PATENT DOCUMENTS

| | | |
|---|---|---|
| JP | 3-294864 | 12/1991 |
| JP | 4-214568 | 8/1992 |
| JP | 5-165257 | 7/1993 |
| JP | 8-179565 | 7/1996 |
| JP | 11-95480 | 4/1999 |
| JP | 2933724 | 5/1999 |
| JP | 11-184239 | 7/1999 |
| JP | 3007693 | 11/1999 |
| JP | 2002-23418 | 1/2002 |
| JP | 2002-31913 | 1/2002 |
| JP | 2003-186240 | 7/2003 |
| JP | 3571900 | 7/2004 |
| JP | 2005-172998 | 6/2005 |
| JP | 2005-339506 | 12/2005 |

OTHER PUBLICATIONS

American Chemical Society (ACS) File Registry No. 114803-11-1, copyright 2010 ACS on STN, which entered STN on Jun. 11, 1988.*
Grant, R., et al., ed., Grant & Hackh's Chemical Dictionary, fifth edition, McGraw-Hill Book Company, NY (1987), pp. 303,434, and 544.*
Diamond, A.S., ed., Handbook of Imaging Materials, Marcel Dekker, Inc., NY (1991), pp. 163 and 165.*
U.S. Appl. No. 12/010,369, filed Jan. 24, 2008, Yasunaga, et al.
U.S. Appl. No. 12/027,704, filed Feb. 7, 2008, Fuwa, et al.
U.S. Appl. No. 11/616,198, filed Dec. 26, 2006, Kadota, et al.
U.S. Appl. No. 12/043,633, filed Mar. 6, 2008, Nakamura, et al.
U.S. Appl. No. 12/046,869, filed Mar. 12, 2008, Nozaki, et al.
U.S. Appl. No. 12/046,952, filed Mar. 12, 2008, Izutani, et al.
U.S. Appl. No. 12/048,865, filed Mar. 14, 2008, Yasunaga, et al.
U.S. Appl. No. 11/965,522, filed Dec. 27, 2007, Fuwa, et al.
U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/035,892, filed Feb. 22, 2008, Kadota, et al.
U.S. Appl. No. 12/046,784, filed Mar. 12, 2008, Nozaki, et al.

(Continued)

*Primary Examiner* — Janis L Dote
(74) *Attorney, Agent, or Firm* — Oblon, Spivak, McClelland, Maier & Neustadt, L.L.P.

(57) ABSTRACT

A toner for electrostatic charge development is provided where the toner comprises a colorant and a resin and contains an organic boron compound represented by a following chemical formula (A) as a charge controlling agent, further the toner is treated with an inorganic fine particle and at least one of the inorganic particles is a magnesium silicate compound represented by a following general formula [2] is provided.

(A)

wherein X is an alkali metal, $R_1$, $R_2$, $R_3$ or $R_4$ each represents a hydrogen atom, an alkyl group having 1 to 4 carbon atoms, an alkoxy group having 1 to 4 carbon atoms, or a halogen atom.

$$Mg_xSi_yO_{(x+2y)} \quad [2]$$

wherein x and y are integers.

12 Claims, 1 Drawing Sheet

OTHER PUBLICATIONS

U.S. Appl. No. 12/046,866, filed Mar. 12, 2008, Matsumoto, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,663, filed Mar. 18, 2008, Izutani, et al.
U.S. Appl. No. 12/050,963, filed Mar. 19, 2008, Ishikawa, et al.
U.S. Appl. No. 12/051,248, filed Mar. 19, 2008, Hagi, et al.
Toshihiko Oguchi, "The Effects of Carrier and External Additives on the Tribocharging Propeties of Toner", Journal of the Imaging Society of Japan, vol. 39, No. 3, Aug. 21, 2000, pp. 254-262 (with Figure 8 contaning English text).
U.S. Appl. No. 11/857,175, filed Sep. 18, 2007, Matsumoto, et al.
U.S. Appl. No. 11/963,279, filed Dec. 21, 2007, Mikuriya, et al.
U.S. Appl. No. 11/779,648, filed Jul. 18, 2007, Yamamoto, et al.
U.S. Appl. No. 12/172,378, filed Jul. 14, 2008, Yamamoto, et al.
U.S. Appl. No. 11/851,048, filed Sep. 6, 2007, Murakami, et al.
U.S. Appl. No. 11/851,617, filed Sep. 7, 2007, Murakami, et al.
U.S. Appl. No. 11/854,783, filed Sep. 13, 2007, Nakamura, et al.
U.S. Appl. No. 11/855,759, filed Sep. 14, 2007, Katoh, et al.
U.S. Appl. No. 11/856,248, filed Sep. 17, 2007, Murakami, et al.
U.S. Appl. No. 11/855,739, filed Sep. 14, 2007, Fuwa, et al.
Office Action issued Aug. 19, 2010 in JP Application No. 2006-059572.

* cited by examiner

TONER AND IMAGE FORMING METHOD

BACKGROUND OF THE INVENTION

1. Field of the Invention

The present invention relates to toner for electrostatic charge development used for copy machines and printers practically applying electrographic technology, and an image forming method using the same.

2. Description of the Related Art

In conventional electrographic methods, a latent electrostatic image formed by charging and exposing a photoconductor surface is developed by colored toners to form a toner image, the toner image is transferred onto a member to be transferred such as transfer paper and this is fixed with a heat roll to form an image.

In a dry development system employed in the electrographs and electrostatic recordings, a system using a two-component developer composed of the toner and a carrier and a system using a one-component developer containing no carrier are available. In the former system, the good images are obtained relatively stably, but the images with constant quality are hardly obtained over a long time because the carrier is easily deteriorated and variation in a mixed ratio of the toner and the carrier occurs easily, and there are also drawbacks in maintenance and downsizing of the apparatus. Thus, the latter system using the one-component developer which does not have such drawbacks has been noticed.

In this system, a procedure in which the toner (developer) is fed by typically at lest one toner feeding member, and the latent electrostatic image formed on a latent image bearing member is visualized by the fed toner is employed. At that time, it has been described that a layer thickness of the toner fed on the surface of the toner feeding member must be thin as possible. In particular, when the one-component developer is used and its toner has high electrical resistance, it is necessary to charge this toner by a developing device. Thus, the layer thickness of the toner must be remarkably thin. Because if this toner layer is thick, only the vicinity of the surface of the toner layer is charged and the entire toner layer is hardly charged uniformly.

In the right of such requests, various procedures (toner layer thickness regulating procedure) to regulate the layer thickness of the toner on the toner feeding member have been proposed, and as a representative, one which controls the layer thickness of the toner by using a pressing member (regulating blade), counterposing this regulating blade to the toner feeding member thereby pressing the toner fed on the toner feeding member surface with the regulating blade is available. A type which obtains the same effect by abutting a roller in place of the blade is also available.

In a developing step, it is necessary to control a charge amount of the toner in a proper range in the toner layer formed on a developing roller surface by the toner layer thickness regulating member. When the charge amount is low, a binding force to the developing roller becomes weak, spout from a developing device and recovery defect to the developing device occur, scattering of the toner and leakage of the toner easily occur. Such phenomena easily occur in a late phase of durability or under a high temperature and high humidity environment.

In order to solve such problems, various treating agents are used as described later, but various problems occur. In magnesium silicate minerals (attapulgite, sepiolite) described in Japanese Patent Application laid-Open (JP-A) No. 2002-31913, a percent of water content is high, charge defect easily occurs even in the ordinary use environment, and problems such as scumming, toner leakage, and toner scattering caused by the charge defect occur easily.

When magnesium silicate treated with silicone oil described in JP-A No. 03-294864, JP-A No. 04-214568 and JP-A No. 05-165257, due to the silicone oil, fluidity of the toner is deteriorated and charge increase is caused, feeding defect and density reduction are caused in the developing device. Magnesium silicate having particle diameters described in Examples is easily dissociated in the developing device, a developing member and the latent image bearing member are easily stained. Particularly in the toner using an organic boron compound, the durability is remarkably deteriorated and the image is harmfully affected.

In the toner described in JP-A No. 11-95480, when the toner is made by using magnesium silicate as a silicate fine powder body and making a coated rate 60% to 100%, if used as a negatively charged toner, a reversely charged toner occurs easily and the scumming is easily caused. Because magnesium silicate easily has the positive charge by the effect of an MgO moiety which easily has the strongly positive charge as shown in the relation with electronegativity (Journal of the Imaging Society of Japan, 39: No. 3:259).

As the toner described in JP-A No. 11-184239, when a titanic acid fine powder body is used, this material itself is low resistant, thus, the leakage of charge is large, the scumming, the toner leakage and the toner scattering occur easily.

As the toner described in JP-A No. 2003-186240, when titania is used, this material itself is low resistant and highly conductive. Thus, it is difficult to control an amount to be added, when added in a large amount, the charge leakage is large and the charge reduction of the entire toner is caused. when added in a small amount, the charge increase is caused. Thus, in both cases, the scumming, the toner leakage and the toner scattering occur easily.

SUMMARY OF THE INVENTION

The present invention has been made for the purpose of solving the above problems in toner for electrostatic charge development used for copy machines and printers practically applying electrographic technology.

An object of the present invention is to provide toner for electrostatic charge development where no scumming occurs, and toner leakage caused by charge defect of the toner on a developing roller is inhibited, and an excellent image stability is obtained by efficiently and uniformly performing frictional charging between the developing roller and a regulating blade in a developing device.

Another object of the present invention relates to a non-magnetic one-component image forming method where no scumming occurs, and toner leakage caused by charge defect of the toner on a developing roller is inhibited, and an excellent image stability is obtained by efficiently and uniformly performing frictional charging between the developing roller and a regulating blade in a developing device in a constitution in which a thin layer forming material in the developing device is a combination of a metal and a resin.

As a result of an extensive study for solving the above problems, the present inventors have found that the above problems can be solved by using a particular organic boron composition as a charge controlling agent as well as treating the toner with a particular inorganic particle, and have completed the present invention.

That is, the present invention is the following (1) to (10).

(1) A toner comprising:

toner particles which comprise a binding resin,a colorant,and a charge controlling agent, and external additives which comprise an inorganic particle, wherein the charge controlling agent is an organic boron compound represented by a following chemical formula (A):

(A)

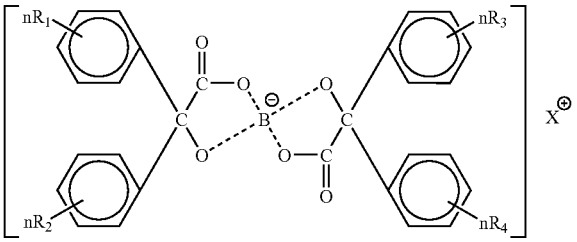

wherein B is boron, X is an alkali metal, $R_1$, $R_2$, $R_3$ or $R_4$ each represents a hydrogen atom, an alkyl group having 1 to 4 carbon atoms, an alkoxy group having 1 to 4 carbon atoms, or a halogen atom, multiple $R_1$, $R_2$, $R_3$ or $R_4$ may be present, when the multiple $R_1$, $R_2$, $R_3$ or $R_4$ are present, they may be different or the same, and n represents an positive integer of 1 to 5;

and the inorganic particle is a magnesium silicate compound represented by the following general formula (2):

$$Mg_xSi_yO_{(x+2y)} \quad (2)$$

wherein x and y are integers, wherein Mohs hardness is 4.5 to 8.

(2) The toner according to according to (1), wherein the organic boron compound represented by the chemical formula (A) is an organic boron compound represented by the following chemical formula [1]:

(1)

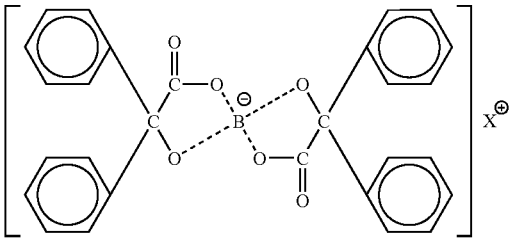

wherein X represents an alkali metal.

(3) The toner according to (1), wherein an average primary particle diameter of the magnesium silicate compound is 0.05 μm to 0.15 μm and an average secondary particle diameter is 0.2 μm to 0.6 μm, and an amount of the magnesium silicate compound added is 0.1 parts by mass to 5 parts by mass relative to 100 parts by mass of the toner base.

(4) The toner according to (1), wherein the magnesium silicate compound is one selected from the group consisting of forsterite, steatite and enstatite.

(5) The toner according to (1), wherein the charge controlling agent is included in the toner in an amount of from 0.5 to 3 parts by weight based on 100 parts by weight of the resin.

(6) A non-magnetic one-component image forming method comprising:

forming a latent electrostatic image on an latent electrostatic bearing member primarily charged, developing the latent electrostatic image by various color toners which multiple developing devices have to form a toner image on the latent electrostatic bearing member by a one-component developing method, transferring the toner image with various colors formed on the latent electrostatic bearing member onto a recording material, and fixing the toner image transferred onto the recording material, wherein the toner comprising a binding resin, a colorant, an inorganic particle and a charge controlling agent, wherein the charge controlling agent is an organic boron compound represented by a following chemical formula (A):

(A)

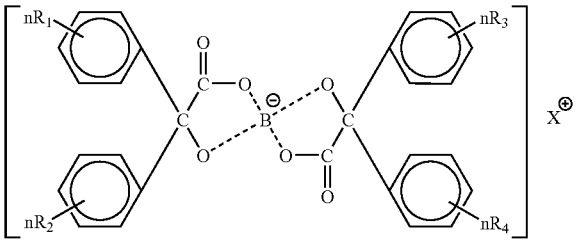

wherein B is boron, X is an alkali metal, $R_1$, $R_2$, $R_3$ or $R_4$ each represents a hydrogen atom, an alkyl group having 1 to 4 carbon atoms, an alkoxy group having 1 to 4 carbon atoms, or a halogen atom, multiple $R_1$, $R_2$, $R_3$ or $R_4$ may be present, when the multiple $R_1$, $R_2$, $R_3$ or $R_4$ are present, they may be different or the same, and n represents an positive integer of 1 to 5;

and the inorganic particle is a magnesium silicate compound represented by the following general formula (2):

$$Mg_xSi_yO_{(x+2y)} \quad (2)$$

wherein x and y are integers, wherein Mohs hardness is 4.5 to 8.

(7) The non-magnetic one-component image forming method according to (6), wherein the developing device used in the developing step has a developing roller and a toner layer thickness regulating member which regulates a layer thickness of the toner formed on the developing roller surface.

(8) The non-magnetic one-component image forming method according to (7), wherein at least a surface layer of the developing roller is composed of a metal and at least a surface layer of the toner layer thickness regulating member is composed of an elastic body.

(9) The non-magnetic one-component image forming method according to (7), wherein at least a surface layer of the developing roller is composed of an elastic body and at least a surface layer of the toner layer thickness regulating member is composed of a metal.

(10) A process cartridge comprising a latent electrostatic image bearing member and at least one unit selected from a charging unit, a developing unit and a cleaning unit, and detachable to an image forming apparatus main body, wherein the developing unit holds a toner,and the toner which comprises a binding resin, a colorant, an inorganic particle and a charge controlling agent, wherein the charge controlling agent is an organic boron compound represented by a following chemical formula (A):

(A)

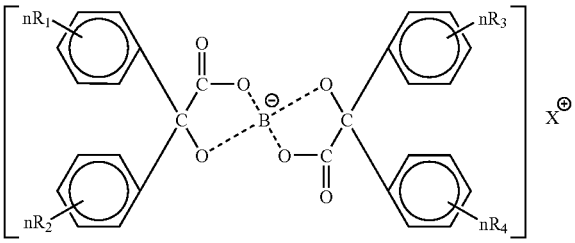

wherein B is boron, X is an alkali metal, $R_1$, $R_2$, $R_3$ or $R_4$ each represents a hydrogen atom, an alkyl group having 1 to 4 carbon atoms, an alkoxy group having 1 to 4 carbon atoms, or a halogen atom, multiple $R_1$, $R_2$, $R_3$ or $R_4$ may be present, when the multiple $R_1$, $R_2$, $R_3$ or $R_4$ are present, they may be different or the same, and n represents an positive integer of 1 to 5;

and the inorganic particle is a magnesium silicate compound represented by the following general formula (2):

$$Mg_xSi_yO_{(x+2y)} \quad (2)$$

wherein x and y are integers, wherein Mohs hardness is 4.5 to 8.

In the toner of the present invention, by efficiently and uniformly performing the frictional charging between the developing roller and the regulating blade, no scumming occurs, and the toner leakage caused by the charge defect of the toner on the developing roller is inhibited, and the excellent image stability can be obtained.

DESCRIPTION OF THE PREFERRED EMBODIMENTS

Figure 1:
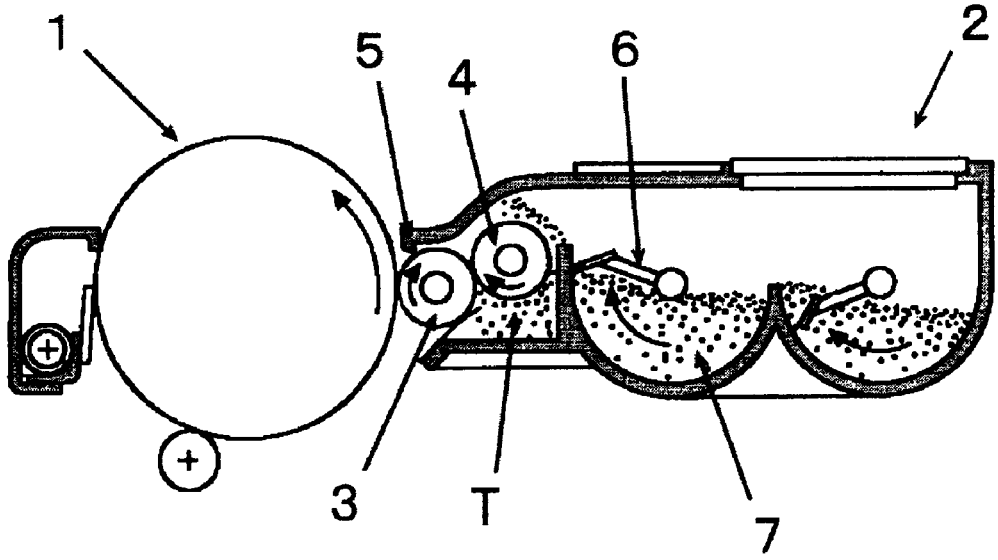
FIG. 1 is a view showing a constitution example of a developing device using toner of the present invention.

The toner of the present invention is the toner externally adding an inorganic particle to a toner base having at least a binding resin, a colorant and a charge controlling agent, characterized in that the charge controlling agent is an organic boron compound represented by a following chemical formula (A):

(A)

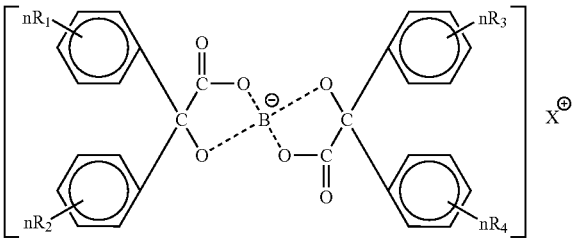

wherein B is boron, X is an alkali metal, $R_1$, $R_2$, $R_3$ or $R_4$ each represents a hydrogen atom, an alkyl group having 1 to 4 carbon atoms, an alkoxy group having 1 to 4 carbon atoms, or a halogen atom, multiple $R_1$, $R_2$, $R_3$ or $R_4$ may be present, when the multiple $R_1$, $R_2$, $R_3$ or $R_4$ are present, they may be different or the same, and n represents an positive integer of 1 to 5;

and the inorganic particle is a magnesium silicate compound represented by the following general formula [2]:

$$Mg_xSi_yO_{(x+2y)} \quad [2]$$

wherein s and y are integers.,wherein Mohs hardness is 4.5 to 8.

The alkyl group include, methyl, ethyl, n-propyl, iso-propyl, n-butyl, iso-butyl, sec-butyl and tert-butyl groups, the alkoxy group includes methoxy, ethoxy, n-propyloxy, iso-propyloxy, n-butyloxy, sec-butyloxy and tert-butyloxy, and the halogen atom includes fluorine, chlorine and bromine atoms.

X is Li, Na or K, and preferably K in consideration of moisture resistance of the toner.

The charge controlling agent in the present invention is readily obtained by adding a compound represented by the following general formula (B) (wherein, $R_1$, $R_2$, $R_3$ or $R_4$ is the same as in the general formula (A)) to an aqueous solution of boric acid and NaOH, KOH or LiOH, and reacting at 80° C. for about 2 hours with stirring.

(B)

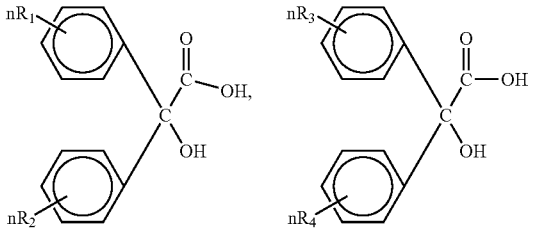

The charge controlling agent which can be used in the present invention are exemplified below

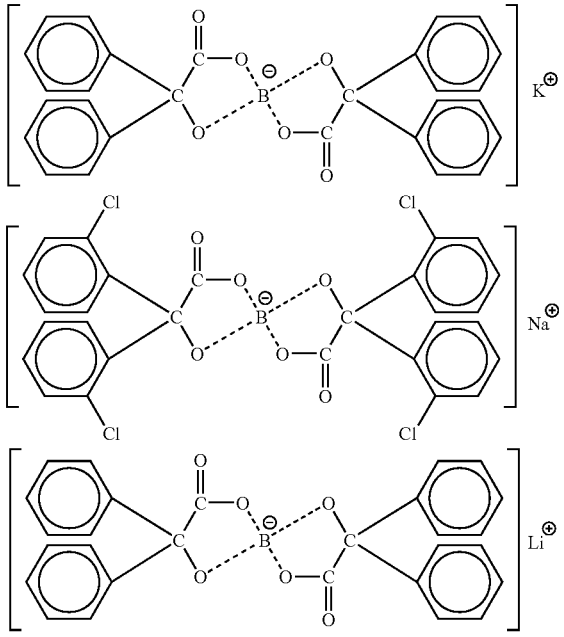

-continued

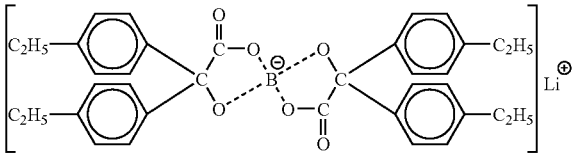

A preferable example of the toner of the present invention is the toner externally adding the inorganic particle to the toner base having at least the binding resin, the colorant and the charge controlling agent, characterized in that the charge controlling agent is the organic boron compound represented by the following formula [1]:

and the inorganic particle is the magnesium silicate compound represented by the following general formula [2]: wherein Mohs hardness is 4.5 to 8.

(1)

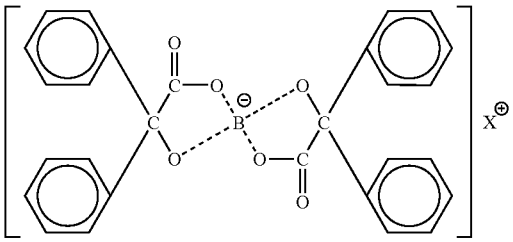

(wherein X represents an alkali metal)

$$Mg_xSi_yO_{(x+2y)} \quad (2)$$

(wherein x and y are integers)

In the magnesium silicate compound, for the purpose of aiding the charge property of toner particles, a specific inductive capacity measured at 1 MHz is preferably 2 to 10 and more preferably 3 to 9, and a volume resistivity is preferably $10^{11}$ Ω·cm or more and more preferably $10^{12}$ Ω·cm or more.

When the inductive capacity is less than 2, the compound does not serve the function as a charging aid, and when it is more than 10, it causes charge up and the charge of the toner in the developing device becomes uneven. When the volume resistivity is less than $10^{11}$ Ω·cm, surface resistance is reduced and the charge defect of the latent electrostatic image bearing member is caused when adhered to a charging member for charging the latent electrostatic image bearing member.

The magnesium silicate compound represented by the above general formula [2] is preferably used as an externally added agent. In particular, forsterite ($Mg_2SiO_4$), steatite and enstatite ($MgSiO_3$) are preferable because they can further exert the effects of the present invention.

The inorganic particle in the present invention could contain the magnesium silicate compound represented by the general formula [2] as a major ingredient, and may additionally contain $SiO_2$—MgO based complex oxide which is not represented by the general formula [2].

A preferable range of the average primary particle diameter of the magnesium silicate compound is 0.05 μm to 0.15 μm, more preferably 0.05 μm to 0.13 μm, still more preferably 0.06 μm to 0.13 μm. The preferable range of the average secondary particle diameter is 0.2 μm to 0.6 μm, more preferably 0.2 μm to 0.5 μm and still more preferably 0.2 μm to 0.45 μm.

When the average secondary particle diameter is larger than 0.6 μm, an adhesive force to the toner is weak and the particle is easily dissociated from the toner. Thus, the particles migrate to the developing roller (toner bearing member), the toner layer thickness regulating member and the latent image bearing member to cause member contamination. Meanwhile, when the average primary particle diameter is smaller than 0.05 μm, the particles are easily embedded in the toner base due to the friction among toner particles one another in the developing device or the friction between the developing roller and the toner layer thickness regulating member, the charge amount in the toner particles is reduced and the charge property on the toner base surface becomes uneven. Thus, toner spill is facilitated due to occurrence of low charged toner particles by extending a toner charge amount distribution.

The Mohs hardness of the particles of the magnesium silicate compound is preferably 4.5 to 8. When the hardness is less than 4.5,filming to the latent electrostatic image bearing member occurs. When it exceeds 8, the latent electrostatic image bearing member easily gets scratched.

The amount of magnesium silicate to be mixed in the toner is 0.1 parts by mass to 5.0 parts by mass, preferably 0.2 parts by mass to 3.0 parts by mass and more preferably 0.3 parts by mass to 2.5 parts by mass. When the amount is less than 0.1 parts by mass, the effects of the present invention are not exerted. When it exceeds 5 parts by mass, the toner charge property is remarkably reduced, leading to the occurrence of the toner spill, excessive toner feeding, the toner scattering and the toner leakage in the apparatus.

A method for producing the magnesium silicate compound of the present invention includes, for example, the method disclosed in JP-A No. 2003-327470.

Forsterite and steatite have the extremely weak adhesive force to the metal although its reason is unknown. Thus, when a thin layer forming member in the developing device is the metal, they inhibit the adhesion of the toner to the metal. When the metal roller is used, they prevent the filming and facilitate enhancement of a toner reset property. When the metal blade is used, they prevent the filming. In the present invention, it is particularly preferable to use the forsterite.

As the charge controlling agent used for the present invention, those represented by the above chemical formula [1] can be preferably used.

$A^+$ in the above chemical formula [1] is the alkali metal ion, and particularly preferably $K^+$.

The charge controlling agent is excellent in charge rising property, and can also be preferably used for colors because of being white. But, in the charge controlling agent, when a durability test or a high temperature and high humidity test is performed, a tendency to reduce the charge amount is observed.

The amount of the charge controlling agent to be added in the toner is 0.5 parts by mass to 3 parts by mass, preferably 0.5 parts by mass to 2.5 parts by mass, and more preferably 0.6 parts by mass to 2.3 parts by mass. When the amount is less than 0.5 parts by mass, the desired charge rising property is not obtained. When it exceeds 3 parts by mass, the charge is largely reduced and the effects of the present invention are hardly obtained.

The toner base which can be used in the present invention typically contains the binding resin, the colorant and the other additives. The toner base includes (1) the toner base obtained by melting and mixing the colorant, the charge controlling agent, the releasing agent and the like in a thermoplastic resin which is the binding resin component to make a composition and subsequently pulverizing and classifying the composition, (2) the toner base obtained by dissolving or suspending the colorant, the charge controlling agent, the releasing agent and the like in a polymerizable monomer which is a binding resin raw material, adding the polymerization initiator, then dispersing in a water-based medium containing a dispersion stabilizer, raising the temperature up to the predetermined temperature to initiate the polymerization, and filtrating, washing, dehydrating and drying after the polymerization, (3) the toner base obtained by agglutinating primary particles of the binding resin containing a polar group obtained by emulsification polymerization by adding the charge controlling agent and the releasing agent to make secondary particles, and filtrating and drying the particles further associated by stirring at higher temperature than the glass transition temperature of the binding resin, and (4) the toner base obtained by a phase change emulsification by making a hydrophilic group-containing resin the binding resin, adding the colorant thereto, which is dissolved in the organic solvent, subsequently neutralizing the resin to change a phase, and then drying to yield the colored particles, and any of them can be used.

Hereinafter, the present invention will be described taking the pulverized toner for instance, but the present invention is not limited thereto.

(Binder Resin)

Types of the binder resin are not particularly limited, and may be the binder resins publicly known in the full color toner field, e.g., polyester based resins, (meth)acrylic resins, styrene-(meth)acryl copolymer resins, epoxy based resins, COC (cyclic olefin resins, e.g., TOPAS-COC supplied from Ticona), and it is preferable to use the polyester based resin in terms of stress resistance in the developing device. These may be used in combination of two or more depending on the cases.

As the polyester based resin preferably used in the present invention, it is possible to use the polyester resin obtained by polycondensing a polyvalent alcohol component and a polyvalent carboxylic acid component. Bivalent alcohol components in the polyvalent alcohol components include, for example, bisphenol A alkylene oxide adducts such as polyoxypropylene (2,2)-2,2-bis(4-hydroxyphenyl)propane, polyoxypropylene (3,3)-2,2-bis(4-hydroxyphenyl)propane, polyoxypropylene (6)-2,2-bis(4-hydroxyphenyl)propane and polyoxyethylene (2,0)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polytetramethylene glycol, bisphenol A and hydrogenated bisphenol A. Trivalent or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylprpanetriol, 2-methyl-1,2,4-butanetriol, trimethylolethane, trimethylolpropane and 1,3,5-trihydroxymethylbenzene.

Bivalent carboxylic acid components in the polyvalent carboxylic acid components include, for example, maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, and anhydrates or lower alkyl esters of these acids.

Trivalent or more carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, empol trimer acid, and anhydrates or lower alkyl esters of these acids.

Also as the polyester based resin in the present invention, it is possible to suitably use the resin (hereinafter referred to as a "vinyl based polyester resin" simply) obtained by using a mixture of a raw material monomer of the polyester resin, a raw material monomer of the vinyl based resin and a monomer which reacts with the raw materials of both the resins, and in parallel, performing the polycondensation to obtain the polyester resin and the radical polymerization to obtain the vinyl based resin in the same vessel. The monomer which reacts with the raw materials of both the resins is, in other words, the monomer usable in both the polycondensation and the radical polymerization, i.e., the monomer having the carboxyl group capable of reacting in the polycondensation and the vinyl group capable of reacting in the radical polymerization, and includes, for example, fumaric acid, maleic acid, acrylic acid and methacrylic acid.

The raw material monomers of the polyester resin include the polyvalent alcohol components and the polyvalent carboxylic components described above. The raw material monomers of the vinyl based resin include styrene or styrene derivatives such as styrene, o-methylstyrene, m-methylstyrene, p-methylstyrene, α-methylstyrene, p-ethylstyrene, 2,4-dimethylstyrene, p-tert-butylstyrene and p-chlorostyrene; unsaturated monoolefins such as ethylene, propylene, butylene and isobutylene; methacrylate alkyl esters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylate alkyl esters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate and dodecyl acrylate; unsaturated carboxylic acids such as acrylic acid, methacrylic acid, itaconic acid and maleic acid; acrylonitrile, maleate ester, itaconate ester, vinyl chloride, vinyl acetate, vinyl benzoate, vinyl methyl ethyl ketone, vinyl hexyl ketone, vinyl methyl ether, vinyl ethyl ether and vinyl isobutyl ether.

The polymerization initiator when the raw material monomer of the vinyl based resin is polymerized includes azo based or diazo based polymerization initiators such as 2,2'-azobis(2,4-dimethylvaleronitrile), 2,2'-azobisisobutylonitrile, 1,1-azobis(cyclohexane-1-carbonitrile) and 2,2'-azobis-4-methoxy-2,4-dimethylvaleronitrile; and peroxide based polymerization initiators such as benzoyl peroxide, dicumyl peroxide, methyl ethyl ketone peroxide, isopropyl peroxycarbonate and lauroyl peroxide.

As the binder resin, various polyester based resins described above are preferably used. Among them, it is effective and preferable to combine a first binder resin and a second binder resin described below in terms of enhancing a separating property and the offset resistance as the toner for oilless fixing.

That is, as the first binder resin, the polyester resins obtained by polycondensing the polyvalent alcohol component and the polyvalent carboxylic acid component described above, particularly the polyester resins obtained using a bisphenol A alkylene oxide adduct as the polyvalent alcohol component and using terephthalic acid and fumaric acid as the polyvalent carboxylic acids are used As the second binder resin, the vinyl based polyester resins, particularly the vinyl based polyester resins obtained using the bisphenol A alkylene oxide adduct, terephthalic acid, trimellitic acid and succinic acid as the raw material monomers of the polyester resin, using styrene and butyl acrylate as the raw material monomers of the vinyl based resin and using fumaric acid as the monomer which reacts with the both are used.

It is preferably to internally add hydrocarbon-based wax upon synthesis of the first binder resin. To previously internally add hydrocarbon-based wax to the first binder resin, the first binder resin could be synthesized with adding hydrocarbon-based wax in the monomers for synthesizing the first binder resin when the first binder resin is synthesized. For example, the polycondensation could be performed in the state where hydrocarbon-based wax has been added to acid monomer and alcohol monomer which compose the polyester-based resin as the first binder resin. When the first binder resin is the vinyl-based polyester resin, the polycondensation and the radical polymerization could be performed by dropping the raw material monomers of the vinyl-based resin with stirring and heating the monomers in the state where hydrocarbon-based wax has been added to the raw material monomers of the polyester resin.

(Wax)

Generally the wax having a lower polarity is more excellent in releasing property from the fixing member roller. The wax used for the present invention is the hydrocarbon based wax having the low polarity.

(Hydrocarbon Based Wax)

The hydrocarbon-based wax is the wax composed of only carbon atoms and hydrogen atoms, and the wax not containing ester, alcohol and amide groups. The hydrocarbon-based wax includes, for example, polyolefin waxes such as polyethylene, polypropylene and copolymers of propylene with ethylene; petroleum waxes such as paraffin wax and microcrystalline wax; and synthetic waxes such as Fisher Tropsch wax. Among them, polyethylene wax, paraffin wax and Fisher Tropsch wax are preferable, and polyethylene wax and paraffin wax are more preferable.

(Melting Point of Wax)

The melting point of the wax is represented by an endothermic peak of the wax upon temperature rising measured by a differential scanning calorimeter (DSC), and is preferably 70° C. to 90° C. When the melting point exceeds 90° C., melt of the wax in a fixing process becomes insufficient and the separation property from the fixing member is not assured sometimes. When it is lower than 70° C., the toner particles are fused one another under the high temperature and high humidity environment, which is problematic in storage stability. To allow for the fixation separation property at low temperature, the melting point of the wax is more preferably 70° C. to 85° C. and still more preferably 70° C. to 80° C.

(Endothermic Peak of Wax)

A half value width of the endothermic peak of the wax upon temperature rising measured by the differential scanning calorimeter (DSC) is preferably 7° C. or below. Since the melting point of the above wax is relatively low, the wax having the broad endothermic peak, i.e., which melts at low temperature harmfully affects the storage stability of the toner.

(Content of Wax)

A content of the wax in the toner of the present invention is preferably 3% by mass to 10% by mass, more preferably 4% by mass to 8% by mass and still more preferably 4% by mass to 6.5% by mass. When the content is less than 3% by mass, the amount of the wax permeated between the melted toner and the fixing member in the fixing process is insufficient. Since the adhesive force between the melted toner and the fixing member is not reduced, the recording member is not separated from the fixing member. Meanwhile, when the content of the wax exceeds 10% by mass, the amount of the wax exposed on the toner surface is increased and the fluidity of the toner is deteriorated. Thus, transfer efficiency from a developing unit to the latent electrostatic bearing member and from the latent electrostatic bearing member to the recording member is reduced, not only the image quality is remarkably reduced, but also the wax is dissociated from the toner surface and contamination of the developing member and the latent electrostatic bearing member is sometimes caused, which is not preferable.

(Content Ratio of First Binder Resin and Second Binder Resin)

A content ratio of the first binder resin (including the amount of the internally added wax) to the second binder resin in the toner particle is preferably 80/20 to 45/55 and more preferably 70/30 to 60/40 by mass ratio. When the amount of the first binder resin is too small, the separation property and the high temperature offset resistance are reduced, which is problematic. When the amount of the first binder resin is too large, glossiness and heat resistant storage stability are reduced.

More preferably, a softening point of the binder resin composed of the first binder resin and the second binder resin used at the above mass ratio is preferably 100° C. to 125° C. and particularly preferably 105° C. to 125° C. In the present invention, the softening point of the binder resin composed of the first binder resin in which the wax has been internally added and the second binder resin could be within the above range.

An acid value of the first binder resin in which the wax has been internally added is preferably 5 KOH mg/g to 50 KOH mg/g and more preferably 10 KOH mg/g to 40 KOH mg/g. The acid value of the second binder resin is preferably 0 KOH mg/g to 10 KOH mg/g and more preferably 1 KOH mg/g to 5 KOH mg/g. In particular, when the polyester resin is used, by using the resin having such an acid value, it is possible to enhance dispersibility of various colorants as well as to make the toner having the sufficient charge amount.

It is preferable in terms of high temperature offset resistance that the first binder resin contains the ingredient which is insoluble in tetrahydrofuran (THF). The content of the ingredient insoluble in THF in the first binder resin in which the wax has been internally added is preferably 0.1 parts by mass to 15 parts by mass, particularly 0.2 parts by mass to 10 parts by mass and more preferably 0.3 parts by mass and 5 parts by mass.

(Colorant)

As the colorant used in the present invention, the publicly known pigments and dyes conventionally used as the colorants for full color toners can be used. For example, carbon black, aniline blue, calcoil blue, chromium yellow, ultramarine blue, DuPont oil red, quinoline yellow, methylene blue chloride, copper phthalocyanine, malachite green oxalate, lamp black, rose Bengal, C.I. pigment red 48, C.I. pigment red 122, C.I. pigment red 57:1, C.I. pigment red 184, C.I. pigment yellow 97, C.I. pigment yellow 12, C.I. pigment yellow 17, C.I. pigment yellow 74, solvent yellow 162,C.I.

pigment yellow 180, C.I. pigment yellow 185, C.I. pigment blue 15:1 and C.I. pigment blue 15:3 can be included. The content of the colorant in the toner particles is preferably in the range of 2 parts by weight to 15 parts by weight relative to 100 parts by weight of the total resins. It is preferable in terms of dispersibility that the colorant is used in the form of the master batch in which the colorant has been dispersed in the mixed binder resin of the first and second binder resins used. The amount of the master batch to be added could be the amount in which the amount of the colorant is in the above range. It is suitable that a content rate of the colorant in the master batch is 20 parts by mass to 40 parts by mass.

(Charge Controlling Agent)

In the present invention, the boron organic compound represented by the above chemical formula [1] is used as the charge controlling agent, but the publicly known charge controlling agent conventionally used for the full color toner may be combined.

For example, nigrosine dyes, triphenylmethane dyes, chromium-containing metal complex dyes, molybdic acid chelate pigments, rhodamine-based dyes, alkoxy-based amine, quaternary ammonium salts (including fluorine modified quaternary ammonium salts), alkylamide, a single body or compounds of phosphorus, a single body or compounds of tungsten, fluorine-based active agents, salicylate metal salts and metal salts of salicylic acid derivatives are included. Specifically, BONTRON 03 of the nigrosine dye, BONTRON P-51 of the quaternary ammonium salt, BONTRON S-34 of the metal-containing azo dye, E-82 of oxynaphthoic acid-based metal complex, E-81 and E-84 of salicylic acid-based metal complexes, E-89 of phenol-based condensate (supplied from Orient Chemical Industries Ltd.); TP-302 and TP-415 of a quaternary ammonium salt molybdenum complexes (supplied from Hodogaya Chemical Co., Ltd.); Copy Charge PSY VP2038 of the quaternary ammonium salts, Copy Blue PR of the triphenylmethane derivative, Copy Charge NEG VP2036 and Copy Charge NX VP434 of the quaternary ammonium salts (supplied from Hoechst); LRA-901, copper phthalocyanine, perylene, quinacridone, azo-based pigments, and polymer-based compounds having functional groups such as sulfonic acid group, carboxyl group and quaternary ammonium salt are included. Among them, in particular, substances which control the toner to negative polarity are preferably used.

The amount of the charge controlling agent to be used is determined depending on a type of the binder resin, the presence or absence of additives used as needed and the method for producing the toner including a dispersion method, and is not primarily limited, but is preferably 0.1 parts by weight to 10 parts by weight and more preferably 0.2 parts by weight to 5 parts by mass relative to 100 parts by weight of the binder resin. When the amount exceeds 10 parts by weight, the charge property of the toner is too large, the effect of the charge controlling agent is attenuated, and an electrostatic suction force to the developing roller is increased, leading to the reduction of the fluidity of the developer and the reduction of the image density.

(Externally Added Agent)

In the present invention, as an externally added agent to aid the fluidity, the developing property and the charge property, other inorganic particles can be used in combination with the aforementioned magnesium silicate compound.

Specific examples of the inorganic fine particles include, for example, silicon oxide, zinc oxide, tin oxide, quartz sand, titanium oxide, clay, mica, sand-lime stone, diatom earth, chromium oxide, cerium oxide, colcothar, antimony trioxide, magnesium oxide, aluminium oxide, zirconium oxide, barium sulfate, barium carbonate, calcium carbonate, silicon carbide, and silicon nitride.

The total amount of the externally added agents in the present invention to be added is preferably 1.0 part by mass to 5.0 parts by mass relative to 100 parts by mass of the toner base. When the total amount of the externally added agents is larger than the above range, fog, the developing property and the fixation separation property are deteriorated. When it is smaller than the above range, the fluidity, the transfer property and the heat resistant storage stability are deteriorated.

(Production Method)

The toner of the present invention can be obtained by mixing, kneading, pulverizing and classifying the first binder resin in which the above hydrocarbon based wax has been internally added, the second binder resin and the colorant by conventional methods to yield the toner particles (colored resin particles) having the desired particle diameter, and mixing the externally added agent therewith. The average particle diameter of the toner particles is 4 μm to 10 μm and preferably 5 μm to 10 μm.

(Constitution of Developing Device)

The developing device has the developing roller and the toner layer thickness regulating member which regulates the thickness of the toner layer formed on the developing roller surface.

The surface material of the developing roller is a metallic material when the toner layer thickness regulating member is an elastic body whereas when the toner layer thickness regulating member is the metal, the developing roller is the elastic body.

First, the case of making the surface material of the developing roller the elastic body will be described.

The developing roller is produced by coating a periphery of a conductive shaft with a rubber elastic body. The conductive shaft is composed of the metal such as stainless.

The surface of the roller coated with the elastic body (elastic rubber, resin, etc.) is provided with a surface coating layer composed of the material easily charged to the polarity opposed to the toner polarity. The elastic body layer is set to have the hardness of 60 degree by JIS-A in order to prevent the toner deterioration due to pressure concentration at the section of abutting with the toner layer thickness regulating member. Its surface roughness Ra is set to 0.3 μm to 2.0 μm, and the toner in required amount is kept on the surface. A development bias for forming an electric field between the developing roller and the latent electrostatic image bearing member is applied to the developing roller. Thus, the elastic body layer is set to have a resistance value of $10^3\Omega$ to $10^{10}\Omega$. The developing roller rotates clockwise, and feeds the toner kept on its surface to the position opposed to the toner layer thickness regulating member and the latent electrostatic image bearing member.

Subsequently, the case where the developing roller is the metal will be described.

A blast treatment with glass beads is given to the developing roller, which forms the predetermined surface roughness. In particular, the case where the developing roller is aluminium material is preferable because its processing is easy. In the developing roller of this aluminium material, the predetermined surface roughness is easily formed by controlling the pressure applied to the glass beads.

The surface roughness (Ra) of the developing roller is set to the range of 0.2 μm to 0.5 μm.

The case where the toner layer thickness regulating member is the metal will be described below.

The toner layer thickness regulating member is provided at the lower position than the position of abutting a supply roller and the developing roller. The toner layer thickness regulating member is obtained by using a metal plate spring material such as SUS and bronze and abutting a free end side onto the surface of the developing roller by a pushing pressure of 10 N/m to 40 N/m, makes the toner passed under the pushing pressure a thin layer and imparts the charge to the toner by frictional charging. Furthermore, in order to aid the frictional charging, a regulatory bias of the value obtained by offsetting to the developing bias in the same direction as the charged polarity of the toner is imparted to the toner layer thickness regulating member.

Subsequently, the case where the toner layer thickness regulating member is the elastic body will be described.

The toner layer thickness regulating member is constituted by attaching the elastic body to the surface of the metal plate spring material such as SUS and bronze.

A rubber elastic body which composes the elastic body used for the surface of the developing roller and the regulating member is not particularly limited, and includes, for example, a styrene-butadiene-based copolymer rubber, acrylonitrile-butadiene-based copolymer rubber, an acryl rubber, an epichlorohydrin rubber, an urethane rubber, a silicone rubber or blended ones of two or more thereof. Among them, the blended rubber of the epichlorohydrin rubber and the acrylonitrile-butadiene-based copolymer rubber is preferably used.

A constitution example of the developing device is shown in FIG. 1. But the present invention is not limited to the following constitution.

The latent electrostatic image bearing member 1 rotates in an arrow direction from downward to upward. The developing roller 3 in the developing device 2 is driven in contact with the latent electrostatic image bearing member 1 or with keeping a gap of about 0.1 to 0.3 in the arrow direction.

The material of the developing roller is composed of a conductive body such as aluminium or stainless keeping the appropriate surface roughness obtained by a sand blast treatment or a conductive rubber material. A toner supply roller 4, one obtained by attaching a rubber plate (urethane rubber, silicon rubber) to a plate spring material, or the toner layer thickness regulating member 5 of the metallic material such as SUS is disposed around the developing roller 3.

In order to supply the toner to the toner supply roller 4, a toner sending shaft 6 is arranged in a freely rotatable mode in a toner keeping room 7 in which the toner T is kept.

The toner of the present invention can be used by being kept in the developing unit in the process cartridge which is integrated with at least one unit selected from the latent electrostatic image bearing member, the charging unit, the developing unit and the cleaning unit and attached detachably to the image forming apparatus main body.

EXAMPLES

The present invention will be specifically described in detail with reference to the following Examples, but the present invention is not limited thereto.

<Measurement and Evaluation Methods>

First, the methods of measuring physical properties of the materials used and the methods of evaluating the obtained samples are described.

(Toner Particle Diameter [Coulter])

The method of measuring the particle size distribution of the toner particles is described. The apparatus for measuring the particle size distribution of the toner particles includes Coulter Counter TA-II and Coulter Multisizer II (both supplied from Coulter). The measurement method will be described below. First, 0.1 mL to 5 mL of a surfactant (alkyl benzene sulfonate salt) as a dispersant was added into 100 mL to 150 mL of an electrolytic aqueous solution. Here, the electrolytic solution is one obtained by preparing 1% by mass NaCl aqueous solution using first class sodium chloride, for example, Isoton-II (supplied from Coulter) can be used. Here, 2 mg to 20 mg of the sample in terms of solid content was further added. The electrolytic solution in which the sample had been suspended was treated using an ultrasonic dispersing machine for 1 to 3 minutes. Using the above measurement apparatus, the toner particles, the volume and the number of the toner particles were measured using 100 μm aperture as the aperture to calculate the volume distribution and the number distribution. From the obtained distributions, the weight average particle diameter (Dv) and the number average particle diameter (Dp) can be calculated. As the channels, thirteen channels of 2.00 μm or more and less than 2.52 μm; 2.52 μm or more and less than 3.17 μm; 3.17 μm or more and less than 4.00 μm; 4.00 μm or more and less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm were used, and the particles having the diameter of 2.00 μm or more and less than 40.30 μm were subjected.

(Softening Point [Tm])

Using a flow tester (CFT supplied from Shimadzu Corporation), 1.5 g of a sample to be measured was weighed, the measurement was performed using a die of H 1.0 mm×φ1.0 mm at a temperature rising speed of 3.0° C./minute, with a preheating time for 180 seconds, a loading of 30 kg, in the measurement temperature range of 80° C. to 140° C., and the temperature at which a half of the above sample was run out was rendered the softening point.

(Measurement of Particle Diameters in Inorganic Fine Particles [TEM])

For the primary particle diameter, the inorganic fine particles were embedded in the resin, a thin slice was made using a microtome, and the particle diameter was measured by observing this under TEM.

For the secondary particle diameter, using a laser diffraction/scattering mode particle size distribution measurement apparatus (LA-920 supplied from HORIBA), 0.1 mL to 5 mL of the surfactant as the dispersant is added and 2 mg to 20 mg of the sample to be measured in terms of solid is added. The solution in which the sample had been suspended was dispersed using the ultrasonic dispersion machine for about one minute to 3 minutes, and the particle diameter was measured using the aforementioned measurement apparatus.

(Mohs Hardness)

The Mohs hardness is determined by whether being scratched or not when rubbed against a mineral as the standard. Just for reference, the minerals as the standards and their hardness are shown in Table 2.

(Evaluation by Actual Machine)

Using IPSiO CX2500 supplied from Ricoh Co., Ltd., a given printing pattern with a printing percentage of 6% were continuously copied on 2,000 sheets under the N/N environment (temperature 23° C. and 45% RH), and then the state of the developing device and the copied image were visually observed and evaluated. The above copy machine has the developing roller made from the metal and the toner layer thickness regulating member made from the elastic body. The evaluation criteria are as follows.

A: good

B: Practically no problem

C: Practically NG

Subsequently, the methods of preparing the materials used for making the toner particle and the toner particle will be described.

(Preparation of Magnesium Silicate Compound)

Slurry of $Mg(OH)_2$ powder and $SiO_2$ powder (average primary particle diameter: 0.02 μm) were weighted so that MgO $SiO_2$ (molar ratio) was 2:1 to make 150 L of the slurry with 71.5 g/L of MgO and 53.3 g/L of $SiO_2$. The slurry was wet-pulverized using a sand grinder mill and using alumina silica based beads of ϕ0.8 mm for the medium under the condition of a medium filled percentage of 80%, a liquid sending speed of 40 L/minute and three slurry passes. The slurry was sprayed and dried using a spray dryer and baked in an electric furnace in atmosphere at 1,100° C. for 30 minutes. Subsequently, the slurry containing 300 g of the baked product was made and 50 L thereof was wet-pulverized using the sand grinder mill and using the alumina silica based beads of ϕ0.8 mm for the medium under the condition of the medium filled percentage of 80%, the liquid sending speed of 40 L/minute and two slurry passes. The slurry was sprayed and dried using the spray dryer, and pulverized using the sand mill to yield the forsterite 1.

The powder obtained as the above was identified by X ray diffraction. As a result, the powder was a single phase of the forsterite. The average primary particle diameter was 0.10 μm, a specific surface area was 18.9 $m^2/g$, and the average secondary particle diameter was 0.39 μm.

The forsterite 2 was obtained in the same way as in the forsterite 1 except that the slurry pass in the wet-pulverization after baking was once.

The powder obtained as the above was identified by X ray diffraction. As a result, the powder was a single phase of the forsterite. The average primary particle diameter was 0.27 μm, a specific surface area was 7.5 $m^2/g$, and the average secondary particle diameter was 2.4 μm.

The enstatite 1 was obtained in the same way as in the forsterite 1 except that the materials were weighted so that MgO: $SiO_2$ (molar ratio) was 1:1 to make 150 L of the slurry with 35.8 g/L of MgO and 53.3 g/L of $SiO_2$.

The powder obtained as the above was identified by X ray diffraction. As a result, the powder was a single phase of the enstatite. The average primary particle diameter was 0.09 μm, a specific surface area was 20.5 $m^2/g$, and the average secondary particle diameter was 0.40 μm.

(Preparation of First Binder Resin)

As the vinyl based monomer, 600 g of styrene, 110 g of butyl acrylate, 30 g of acrylic acid and 30 g of dicumyl peroxide as the polymerization initiator were placed in a dropping funnel. In a 5 liter four-necked flask equipped with a thermometer, a stainless stirrer, a falling type condenser and a nitrogen introducing tube, 1230 g of polyoxypropylene (2.2)-2,2-bis(4-hydroxyphenyl)propane, 290 g of polyoxyethylene (2.2)-2,2-bis(4-hydroxyphenyl)propane as polyol among monomers of polyester, 250 g of isododecenyl succinic acid anhydrate, 310 g of terephthalic acid, 180 g of 1,2,4-benzene tricarboxylic acid anhydrate, 7 g of dibutyl tin oxide as an esterification catalyst and 340 g (11.0 parts by mass relative to 100 parts by mass of the monomers) of paraffin wax (melting point 73.3° C., a half value width of an endothermic peak at temperature rising measured by a differential scanning calorimeter was 4° C.) as the wax were placed. Subsequently, under a nitrogen atmosphere in a mantle heater, with stirring at a temperature of 160° C., the mixture of the vinyl-based monomer and the polymerization initiator was dripped from the above dropping funnel over one hour. Then, with keeping at 160° C., an addition polymerization reaction was matured for 2 hours, and subsequently the temperature was raised to 230° C. and a polycondensation reaction was performed.

A polymerization degree was followed by the softening point measured using a constant load extrusion capillary rheometer, and the reaction was terminated when the desired softening point was reached to yield a resin H1. The softening point of the resulting resin was 130° C.

(Preparation of Second Binder Resin)

In a 5 liter four-necked flask equipped with a thermometer, a stainless stirrer, a falling type condenser and a nitrogen introducing tube, 2210 g of polyoxypropylene (2.2)-2,2-bis (4-hydroxyphenyl)propane as polyol, 850 g of terephthalic acid, 120 g of 1,2,4-benzene tricarboxylic acid anhydrate and 0.5 g of dibutyl tin oxide as the esterification catalyst were placed. Then, under the nitrogen atmosphere in the mantle heater, the temperature was raised to 230° C. and the polycondensation reaction was performed. The polymerization degree was followed by the softening point measured using the constant load extrusion capillary rheometer, and the reaction was terminated when the desired softening point was reached to yield a resin L1. The softening point of the resulting resin was 115° C.

(Preparation of Toner Particles)

To 100 parts by mass (including the mass of the internally added wax) of the binder resin comprising the first binder resin and the second binder resin at a ratio of 7:3, a master batch containing pigment C.I. pigment blue 15:3 corresponding to 4 parts by mass and one part by mass of an organic 1 boron compound (LR-147 supplied from Japan Carlit Co., Ltd.) in which $A^+$in the chemical formula [1] was $K^+$as the charge controlling agent were added. Then the mixture was mixed using a HENSCHEL MIXER, and subsequently melted and kneaded using a biaxial extrusion kneader (PCM-30 supplied from Ikegai Tekkosho) whose discharge section had been removed. A resulting kneaded product was pressed and extended to a thickness of 2 mm using a cooled press roller, cooled with a cooling belt, and subsequently roughly pulverized using a feather mill. Subsequently, a pulverized product was pulverized using a mechanical pulverizer (KTM supplied from Kawasaki Heavy Industries, Ltd.) until the average particle diameter of 10 μm to 12 μm was obtained. Then, colored resin particles 1 were obtained by pulverizing using a jet pulverizer (IDS supplied from Nippon Pneumatic MFG. Co., Ltd.) with roughly classifying and subsequently classifying fine powder using a rotor type classifying machine (deep lex type classifying machine 100ATP supplied from Hosokawa Micron Ltd.). The average particle diameter of the resulting colored resin particles was 7.9 μm.

Example 1

To 100 parts by mass of the colored resin particles obtained as the above, 1 part by mass of the forsterite 1 (first inorganic fine particle) and 1 part by mass of silica RX200 ( supplied from Japan Aerosil Co., Ltd., primary particle diameter: 12 nm, HMDS surface treatment) were added, and mixed using the HENSCHEL MIXER (at a peripheral velocity of 40 m/s for 60 seconds) to make the cyan toner 1.

The results of evaluating the toners obtained are shown in Table 1.

Examples 2 to 7 and Comparative Examples 1 and 8

The cyan toners 2 to 16 of Examples 2 to 7 and Comparative Examples 1 and 8 were made in the same way as in Example 1, except that the externally added agent described in Table 1 was used.

The results of evaluating the toners obtained are shown in Table 1.

TABLE 1

| | | Externally added agent * First inorganic fine particle | | | | |
|---|---|---|---|---|---|---|
| | Toner No. | Type | Primary particle diameter | Secondary particle diameter | Mohs hardness | Added amount |
| Example 1 | Cyan toner-1 | $Mg_2SO_4$ Forsterite 1 | 0.1 | 0.39 | 7 | 1 |
| Example 2 | Cyan toner-2 | $Mg_2SO_4$ Forsterite 1 | 0.1 | 0.39 | 7 | 1 |
| Example 3 | Cyan toner-3 | $Mg_2SO_4$ Forsterite 1 | 0.1 | 0.39 | 7 | 5.5 |
| Example 4 | Cyan toner-4 | $Mg_2SO_4$ Forsterite 1 | 0.1 | 0.39 | 7 | 0.05 |
| Example 5 | Cyan toner-5 | $MgSiO_3$ Enstatite 1 | 0.09 | 0.4 | 7 | 1 |
| Example 6 | Cyan toner-6 | $Mg_2SO_4$ Forsterite 2 | 0.27 | 2.4 | 7 | 1 |
| Example 7 | Cyan toner-7 | $Mg_2SO_4$ Forsterite 1 | 0.1 | 0.39 | 7 | 1 |
| Example 8 | Cyan toner-8 | $Mg_2SO_4$ Forsterite 1 | 0.1 | 0.39 | 7 | 1 |
| Comparative Example 1 | Cyan toner-9 | None | — | — | — | — |
| Comparative Example 2 | Cyan toner-10 | $Mg_2SO_4$ Forsterite 1 | 0.1 | 0.39 | 7 | 1 |
| Comparative Example 3 | Cyan toner-11 | Talc | 0.94 | — | 1 | 1 |
| Comparative Example 4 | Cyan toner-12 | Attapulgite | 0.1 | — | 2.5 | 1 |
| Comparative Example 5 | Cyan toner-13 | $Mg_2SO_4$ Forsterite 1 | 0.1 | 0.39 | 7 | 1 |
| Comparative Example 6 | Cyan toner-14 | $TiO_2$ STT-30S | 0.015 | — | 6 | 0.3 |
| Comparative Example 7 | Cyan toner-15 | Strontium titanate, SW-100 | 0.35 | — | 6 | 1 |
| Comparative Example 8 | Cyan toner-16 | AlO2 AEROXIDE AluC | 0.013 | — | 9 | 0.3 |

* One part by weight of silica RX200 as the second inorganic fine particle was added in all of Examples and Comparative Examples.

| | Charge controlling agent | | Developing device constitution ** | | Evaluation | | | |
|---|---|---|---|---|---|---|---|---|
| | Type | Amount | Roller | Blade | Scumming | Toner leakage | Image density | *** filming |
| Example 1 | LR147 | 1 | M | E | A | A | A | A |
| Example 2 | LR147 | 1 | E | M | A | A | A | A |
| Example 3 | LR147 | 1 | M | E | A | A | B | A |
| Example 4 | LR147 | 1 | M | E | B | B | A | A |
| Example 5 | LR147 | 1 | M | E | A | A | A | A |
| Example 6 | LR147 | 1 | M | E | B | B | A | A |
| Example 7 | LR147 | 0.3 | M | E | A | A | B | A |
| Example 8 | LR147 | 3.5 | M | E | B | A | A | A |
| Comparative Example 1 | LR147 | 1 | M | E | C | C | A | A |
| Comparative Example 2 | None | — | M | E | C | C | C | A |
| Comparative Example 3 | LR147 | 1 | M | E | B | B | A | C |
| Comparative Example 4 | LR147 | 1 | M | E | B | B | A | C |
| Comparative Example 5 | N4P * | 1 | M | E | A | C | A | A |
| Comparative Example 6 | LR147 | 1 | M | E | B | C | A | A |

TABLE 1-continued

| | | | | | | | |
|---|---|---|---|---|---|---|---|
| Comparative Example 7 | LR147 | 1 | M | E | B | C | A | A |
| Comparative Example 8 | LR147 | 1 | M | E | C | C | A | A |

* Organic modified clay (bentonite-based CCA) supplied from Clariant.
** M: metal. E: elastic body
*** Photoconductor filming

TABLE 2

| Mohs hardness | | |
|---|---|---|
| Hardness No 1 | talk | $Mg_3(OH)_2(S_4O_{10})$ |
| Hardness No 2 | gypsum | $CaSO_42H_2O$ |
| Hardness No 3 | calcite | $CaCO_3$ |
| Hardness No 4 | fluorite | $CaF_2$ |
| Hardness No 5 | apatite | $Ca_3F(PO_4)_3$ |
| Hardness No 6 | orthoclaes | $K(AlSi_3O)_8$ |
| Hardness No 7 | quartz | $SiO_2$ |
| Hardness No 8 | topaz | $Al_2(FOH)_2(SiO_4)$ |
| Hardness No 9 | corundum | $Al_2O_3$ |
| Hardness No 10 | diamond | C |

By using the toner of the present invention, no scumming occurs, and the toner leakage caused by the charge defect of the toner on the developing roller can be inhibited, and the excellent image stability is obtained. Thus, the toner of the present invention can be suitably used as the toner for the electrostatic charge development used for the copy machines and printers practically applying the electrographic technology.

What is claimed is:

1. A toner comprising:

toner particles which comprise a binding resin, a colorant, and a charge controlling agent, and external additives which comprise an inorganic particle, wherein the charge controlling agent is an organic boron compound represented by formula (A):

(A)

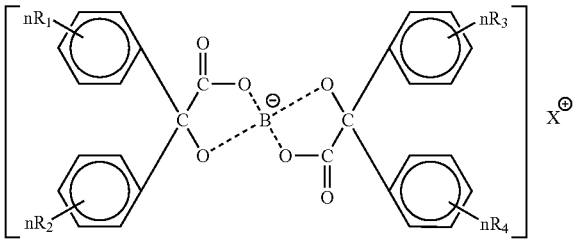

wherein B is boron, X is an alkali metal, $R_1$, $R_2$, $R_3$ or $R_4$ each represents a hydrogen atom, an alkyl group having 1 to 4 carbon atoms, an alkoxy group having 1 to 4 carbon atoms, or a halogen atom, multiple $R_1$, $R_2$, $R_3$ or $R_4$ may be present, when the multiple $R_1$, $R_2$, $R_3$ or $R_4$ are present, they may be different or the same, and n represents a positive integer of 1 to 5;

and the inorganic particle is a magnesium silicate compound represented by formula (2):

$$Mg_xSi_yO_{(x+2y)} \quad (2)$$

wherein x and y are integers, a Mohs hardness of the inorganic particle is 4.5 to 8 and the magnesium silicate compound is one selected from the group consisting of forsterite and enstatite, and wherein an average primary particle diameter of the magnesium silicate compound is 0.05 μm to 0.15 μm and an average secondary particle diameter of the magnesium silicate compound is 0.2 μm to 0.6 μm, and an amount of the magnesium silicate compound added is 0.1 parts by mass to 5 parts by mass relative to 100 parts by mass of the toner particles.

2. The toner according to claim 1, wherein the organic boron compound represented by the chemical formula (A) is an organic boron compound represented by the following chemical formula [1]:

(1)

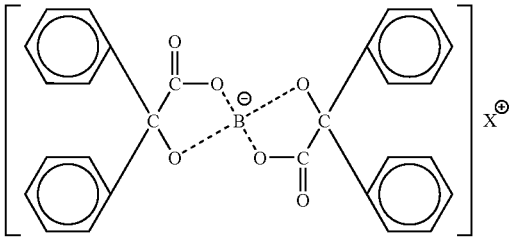

wherein x represents an alkali metal.

3. The toner according to claim 1, wherein the charge controlling agent is included in the toner in an amount of from 0.5 to 3 parts by weight based on 100 parts by weight of the resin.

4. The toner according to claim 1, wherein a specific inductive capacity of the magnesium silicate compound measured at 1 MHz is in a range of from 2 to 10.

5. The toner according to claim 1, wherein a specific inductive capacity of the magnesium silicate compound measured at 1 MHz is in a range of from 3 to 9.

6. The toner according to claim 1, wherein a volume resistivity of the magnesium silicate compound is $10^{11}$ Ω·cm or more.

7. The toner according to claim 1, wherein the average second particle diameter of the magnesium silicate compound is in a range of from 0.2 to 0.5 μm.

8. A process cartridge comprising:

a latent electrostatic image bearing member, a developing unit, and at least one unit selected from the group consisting of a charging unit and a cleaning unit, wherein the process cartridge is detachable to an image forming apparatus main body, wherein the developing unit holds a toner, and the toner comprises a binding resin, a colorant, an inorganic particle and a charge controlling agent, wherein the charge controlling agent is an organic boron compound represented by formula (A):

(A)

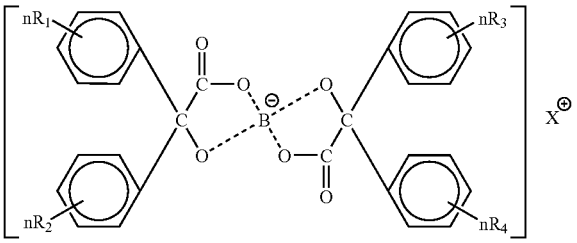

wherein B is boron, X is an alkali metal, $R_1$, $R_2$, $R_3$ or $R_4$ each represents a hydrogen atom, an alkyl group having 1 to 4 carbon atoms, an alkoxy group having 1 to 4 carbon atoms, or a halogen atom, multiple $R_1$, $R_2$, $R_3$ or $R_4$ may be present, when the multiple $R_1$, $R_2$, $R_3$ or $R_4$ are present, they may be different or the same, and n represents a positive integer of 1 to 5;

and the inorganic particle is a magnesium silicate compound represented by formula (2):

$$Mg_xSi_yO_{(x+2y)} \quad (2)$$

wherein x and y are integers, wherein a Mohs hardness of the inorganic particle is 4.5 to 8 and the magnesium silicate compound is one selected from the group consisting of forsterite and enstatite, and wherein an average primary particle diameter of the magnesium silicate compound is 0.05 μm to 0.15 μm and an average secondary particle diameter is 0.2 μm to 0.6 μm, and an amount of the magnesium silicate compound added is 0.1 parts by mass to 5 parts by mass relative to 100 parts by mass of the toner particles.

9. The process cartridge according to claim 8, wherein a specific inductive capacity of the magnesium silicate compound measured at 1 MHz is in a range of from 2 to 10.

10. The process cartridge according to claim 8, wherein a specific inductive capacity of the magnesium silicate compound measured at 1 MHz is in a range of from 3 to 9.

11. The process cartridge according to claim 8, wherein a volume resistivity of the magnesium silicate compound is $10^{11}$ Ω·cm or more.

12. The process cartridge according to claim 8, wherein the average second particle diameter of the magnesium silicate compound is in a range of from 0.2 to 0.5 μm.

* * * * *